US010049525B2

(12) United States Patent
Schwartz

(10) Patent No.: US 10,049,525 B2
(45) Date of Patent: Aug. 14, 2018

(54) CASH MACHINE CASSETTE MANAGEMENT

(71) Applicant: Global Payments Gaming Services Inc., Las Vegas, NV (US)

(72) Inventor: Andrew J. Schwartz, Las Vegas, NV (US)

(73) Assignee: Global Payments Gaming Services, Inc., Las Vegas, NV (US)

( * ) Notice: Subject to any disclaimer, the term of this patent is extended or adjusted under 35 U.S.C. 154(b) by 0 days.

(21) Appl. No.: 15/480,516

(22) Filed: Apr. 6, 2017

(65) Prior Publication Data

US 2017/0301171 A1 Oct. 19, 2017

Related U.S. Application Data

(60) Provisional application No. 62/322,264, filed on Apr. 14, 2016.

(51) Int. Cl.

| | |
|---|---|
| ***G07F 11/00*** | (2006.01) |
| ***G07D 11/00*** | (2006.01) |
| ***G07F 19/00*** | (2006.01) |

(52) U.S. Cl.

CPC ..... *G07D 11/0078* (2013.01); *G07D 11/0006* (2013.01); *G07D 11/0045* (2013.01); *G07D 11/0048* (2013.01); *G07D 11/0057* (2013.01); *G07D 11/0063* (2013.01); *G07F 19/203* (2013.01)

(58) Field of Classification Search

None

See application file for complete search history.

(56) References Cited

U.S. PATENT DOCUMENTS

| | | | | |
|---|---|---|---|---|
| 8,893,959 | B1 * | 11/2014 | Graef | B65H 29/12 235/379 |
| 2002/0053594 | A1 * | 5/2002 | Haney | B65H 5/025 235/381 |
| 2010/0288831 | A1 * | 11/2010 | Graef | B65H 1/26 235/379 |
| 2014/0263619 | A1 * | 9/2014 | Turocy | G07F 19/201 235/379 |

* cited by examiner

*Primary Examiner* — Kristy A Haupt

(74) *Attorney, Agent, or Firm* — Mendelsohn Dunleavy P.C.; Steve Mendelsohn

(57) ABSTRACT

In one embodiment, a method for managing a cash machine having at least one deployed cash cassette having a picking assembly includes (a) determining that the deployed cash cassette should be replaced and (b) generating a cassette-replacement message in order to have a new cash cassette shipped to the cash machine to enable the deployed cash cassette to be replaced with the new cash cassette. In one implementation, the deployed cash cassette includes a cash store that stores currency bills, a picking assembly that retrieves currency bills from the cash store for dispensing from the cash machine and a cassette controller that controls operations of the cash cassette, wherein the cassette controller determines that the cash cassette should be replaced.

15 Claims, 3 Drawing Sheets

100

CASH MACHINE CASSETTE MANAGEMENT

CROSS-REFERENCE TO RELATED APPLICATIONS

This application claims the benefit of the filing date of U.S. provisional application Ser. No. 62/322,264, filed on Apr. 14, 2016, the teachings of which are incorporated herein by reference in their entirety.

BACKGROUND

Field of the Invention

The present invention relates to cash machines, such as casino kiosks and bank automated teller machines (ATMs), and, more specifically, to cassettes for holding paper currency in such cash machines.

Description of the Related Art

This section introduces aspects that may help facilitate a better understanding of the invention. Accordingly, the statements of this section are to be read in this light and are not to be understood as admissions about what is prior art or what is not prior art.

Conventional cash machines, such as casino kiosks and bank ATMs, are capable of dispensing paper currency (aka bills) of different denominations. A given cash machine will have multiple cash cassettes, each of which stores bills of a specific denomination. For example, a cash machine in the United States may have one or more $1 cassettes for storing one-dollar bills, one or more $5 cassettes for storing five-dollar bills, one or more $10 cassettes for storing ten-dollar bills, one or more $20 cassettes for storing twenty-dollar bills, and/or one or more $100 cassettes for storing hundred-dollar bills.

For a particular bill-dispensing operation, the cash machine will dispense an appropriate number of bills of one or more different denominations from corresponding cassettes. For example, a bill-dispensing operation for $279 may involve the dispensing of two $100 bills from one or more $100 cassettes, three $20 bills from one or more $20 cassettes, one $10 bill from a $10 cassette, one $5 bill from a $5 cassette, and four $1 bills from one or more $1 cassettes.

For each cassette, the cash machine has a picking assembly that is designed to remove one bill at a time from the cassette. In some types of cash machines, the picking assemblies are part of the machine's bill dispenser apparatus, where the picking assemblies are separate from the individual cassettes. In other types of cash machines, each cassette has its own built-in picking assembly that interacts with the machine's bill dispenser to sequentially dispense bills from the cassette.

Conventional cash machines are able to prevent bills from being improperly dispensed from a cassette, where improper dispensing includes the dispensing of torn or folded bills as well as the dispensing of an incorrect number of bills. When a cash machine detects that such improper dispensing is about to occur, the cash machine directs the improperly dispensed bills to a special, internal discard bin rather than dispensing them from the machine. For cash machines that operate with cassettes having built-in picking assemblies, the intelligence for detecting improper bills is built into the cassette itself. Such a "smart" cassette is capable of communicating with the cash machine via an appropriate system interface to inform the cash machine of the existence of the improper bills and the need to direct them to the discard bin.

Whether they are an integral part of the cash machine's bill dispenser or built into the individual cassettes, picking assemblies are known to have limited lifetimes. As such, companies that operate cash machines typically schedule periodic maintenance operations in which a technician will travel to the site of the machine and replace the machine's picking assemblies. For cash machines that operate with smart cassettes having built-in picking assemblies, this routine maintenance typically involves the technician replacing each existing cassette with a different cassette having either a new or a refurbished picking assembly.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Figure 1:
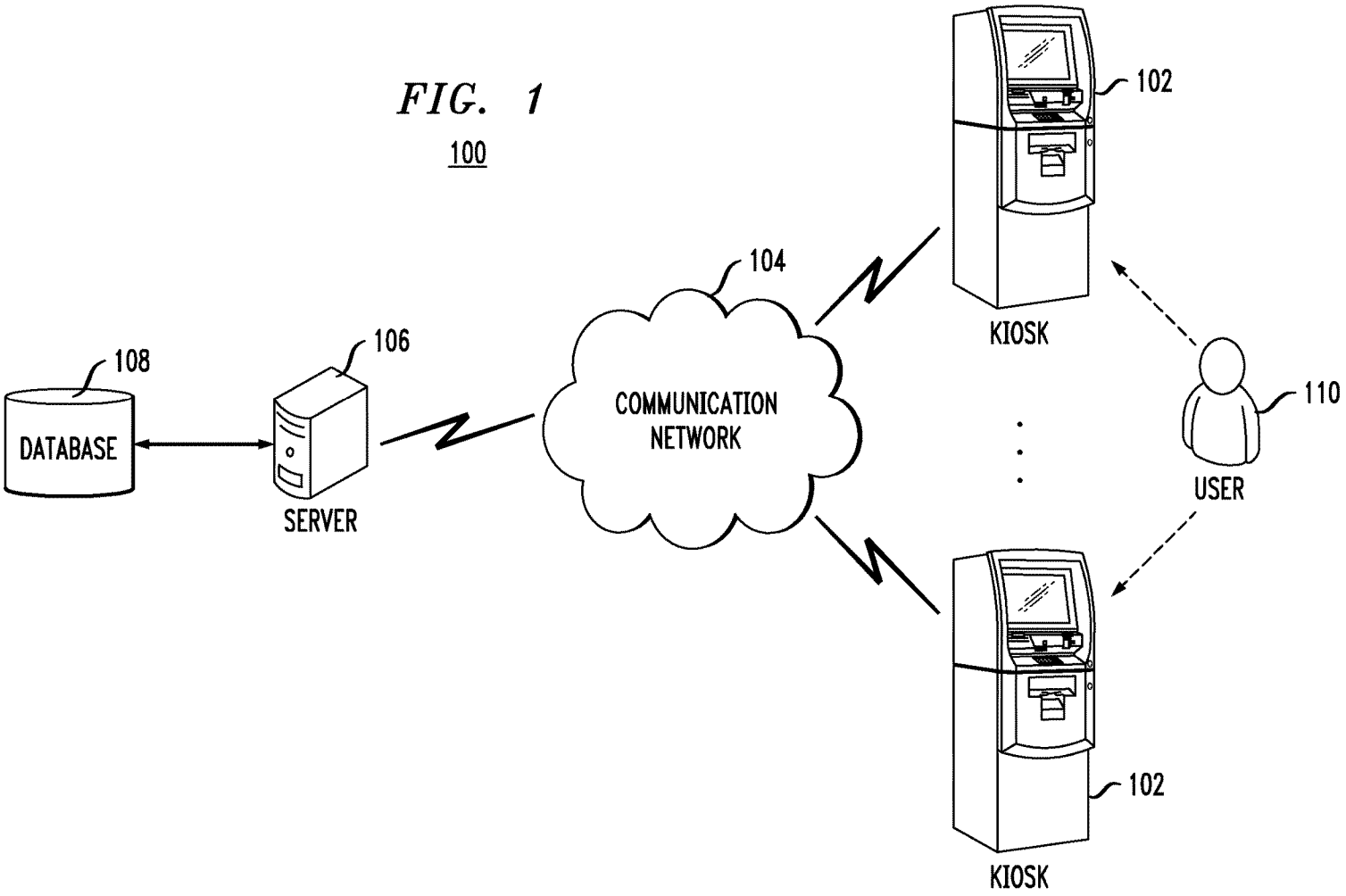
FIG. 1 is a simplified, high-level block diagram of a distributed casino system according to one possible embodiment of the invention in which the cash machines are casino kiosks.

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

The operating life of a picking assembly for a cash machine is typically a function of the total number of bills that have been dispensed by that picking assembly over its lifetime. For example, a particular picking assembly design may be known to begin to fail with significant frequency after the picking assembly has dispensed three million bills.

A cash machine will typically dispense bills of different denominations at difference rates. For example, a cash machine in the U.S. may dispense $20 bills much more frequently than $5 bills or $100 bills. In order to maintain proper operations of such a cash machine, the maintenance schedule is driven by the picking assembly that is used most frequently. Even if a cash machine is provisioned with more $20 cassettes than $5 or $100 cassettes, the likelihood of all of the picking assemblies approaching the expected ends of their operating lives at the same time is very slim. As a result, technicians typically end up replacing many picking assemblies before they have reached the expected ends of their operating lives, resulting in cost inefficiencies.

According to certain embodiments of the present invention, for cash machines that use cash cassettes having built-in picking assemblies, a cassette management (CM) controller is provided that can keep track of the number of bills dispensed by each picking assembly associated with that machine. When the CM controller detects that the number of bills dispensed by a particular picking assembly has reached or will soon reach its expected limit, the CM controller sends a message, for example, to a centralized network server, indicating that the existing cassette having that expired, built-in picking assembly should be replaced with a new cassette. A new cassette can then be mailed or shipped to the site of the machine to be used to replace the old cassette. The old cassette can then be shipped to an off-site location to have the picking assembly replaced or refurbished so that the cassette is once again available to be deployed in the field for use in replacing another, existing cassette having an expired picking assembly.

In one possible implementation, each cassette has its own built-in CM controller. In another possible implementation, a single CM controller is integrated into the cash machine's controller separate from the individual cassettes, where the single CM controller provides the cassette management control functions for all of the cassettes in the cash machine.

In either case, in some implementations, the CM controller is capable of communicating with the cassette circuitry that detects the existence of improper bills. If the CM controller determines that improper bills are occurring for a particular cassette with too great a frequency, then the CM controller can again send a message to have the existing cassette replaced with a new cassette.

In some implementations, the CM controller is further configured to request replacement of any existing cassette that has been deployed for a duration longer than a specified time limit, even if the existing cassette has not yet reached the specified threshold number of bills dispensed.

The CM controller can be implemented using any suitable type of hardware including programmable microprocessors, application-specific integrated circuits (ASICs), and/or field-programmable gate arrays (FPGAs).

Individual cash machines are typically configured as nodes of a distributed network having a centralized network server. According to certain embodiments of the present invention, the CM controllers are configured to send requests for new cassettes to the network server to handle and coordinate the satisfaction of those requests, including the appropriate shipment of a new cassette for each request.

FIG. 1 is a simplified, high-level block diagram of a distributed casino system 100 according to one possible embodiment of the invention in which the cash machines are casino kiosks 102. As shown in FIG. 1, the casino system 100 has a plurality of kiosks 102 that are configured to communicate via a suitable communication network 104 with a centralized network server 106 that accesses a database 108 storing information about casino patrons' player accounts. The casino system 100 enables patrons, like user 110, to operate the kiosks 102 to perform kiosk functions, such as voucher-redemption operations, bill-breaking operations, and bank withdrawals.

The communication network 104 may include a local area network (LAN), a wide area network (WAN), and/or a global area network (GAN). The communication network 104 may provide for wireline, wireless, or a combination of wireline and wireless communication between devices in the network. The server 106 is any suitable processor-based computer node or sub-system, and database 108 is stored in any suitable computer memory device accessible by the server 106.

Figure 2:
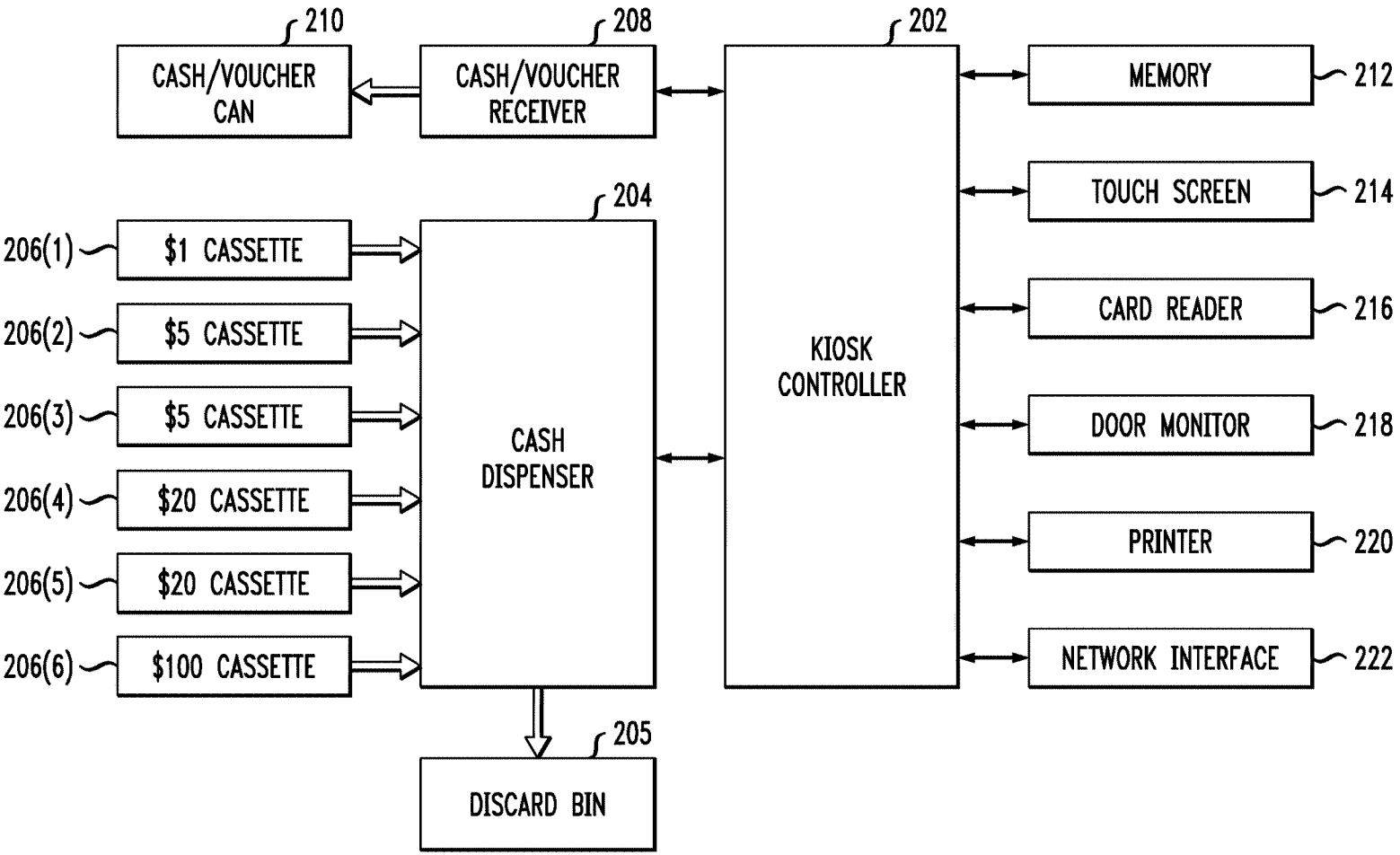
FIG. 2 is a simplified, high-level block diagram of a kiosk that may be used to implement any of the casino kiosks of FIG. 1, according to one embodiment of the invention.

FIG. 2 is a simplified, high-level block diagram of a kiosk 200 that may be used to implement any of the casino kiosks 102 of FIG. 1, according to one embodiment of the invention. As shown in FIG. 2, kiosk 200 has six cash cassettes: one $1 cassette 206(1), two $5 cassettes 206(2) and 206(3), two $20 cassettes 206(4) and 206(5), and one $100 cassette 206(6). Other implementations of kiosks 102 of FIG. 1 may have different numbers of cash cassettes provisioned for different denominations of paper currency. In addition, kiosk 200 has the following elements configured to perform the following functions that support user operation of kiosk 200:

- Kiosk controller 202 configured to control all of the automated operations of kiosk 200;
- Cash dispenser 204 configured to retrieve bills from the appropriate cash cassettes 206 and present the retrieved bills to the user;
- Discard bin 205 configured to receive improper bills from the cash dispenser 204;
- Cash/voucher receiver 208 configured to receive paper currency and vouchers inserted by the user and store them in the cash/voucher can 210;
- Memory 212 configured to store software programs and data for the kiosk controller 202;
- Touch screen 214 configured to display textual and graphical information to the user and to receive manual data inputs from the user;
- Card reader 216 configured to receive and read the user's player card, credit/debit card, or identification card;
- Door monitor 218 configured to detect and record access to the discard bin 205, the cash cassettes 206, and the cash/voucher can 210;
- Printer 220 configured to print receipts and vouchers for the user; and
- Network interface 222 configured to enable the kiosk controller 202 to communicate with the casino-system server 106 of FIG. 1 via the communication network 104.

Note that, in some implementations, the discard bin 205 and the cash/voucher can 210 are the same component.

In certain embodiments, the cash dispenser 204 may be either a present-type cash dispenser that collects all of the bills from the appropriate cash cassettes 206 and presents them to the user as a single stack of bills or a dispense-type cash dispenser that sequentially retrieves cash from appropriate cash cassettes 206 and presents the cash to the user one bill at a time.

Kiosk 200 is configured to support the normal range of functions provided to patrons of casinos or other gaming enterprises. In addition, as described further below, kiosk 200 is configured to support the cassette-management operations of this invention.

Figure 3:
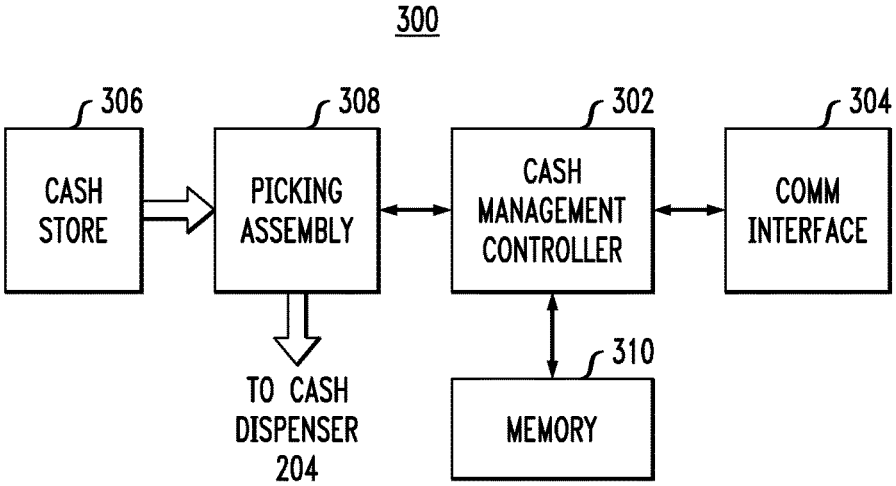
FIG. 3 is a simplified, high-level block diagram of the electrical components and the electro-mechanical mechanisms of a smart cash cassette that may be used to implement any of the cash cassettes of FIG. 2, according to one embodiment of the invention that employs smart cash cassettes having their own cassette management controllers.

FIG. 3 is a simplified, high-level block diagram of the electrical components and the electro-mechanical mechanisms of a smart cash cassette 300 that may be used to implement any of the cash cassettes 206 of FIG. 2, according to one embodiment of the invention that employs smart cash cassettes having their own cassette management controllers. As shown in FIG. 3, smart cassette 300 includes:

- Cassette management (CM) controller 302 (e.g., a microprocessor board) configured to manage the operations of the smart cassette 300 and communicate with the kiosk controller 202 of FIG. 2 via communication interface 304;
- Cash store 306 configured to store bills for the smart cassette 300;
- Picking assembly 308 configured to sequentially retrieve bills from the cash store 306 and present them to the cash dispenser 204 of FIG. 2; and
- Memory 310 configured to store data for the CM controller 302.

Figure 4:
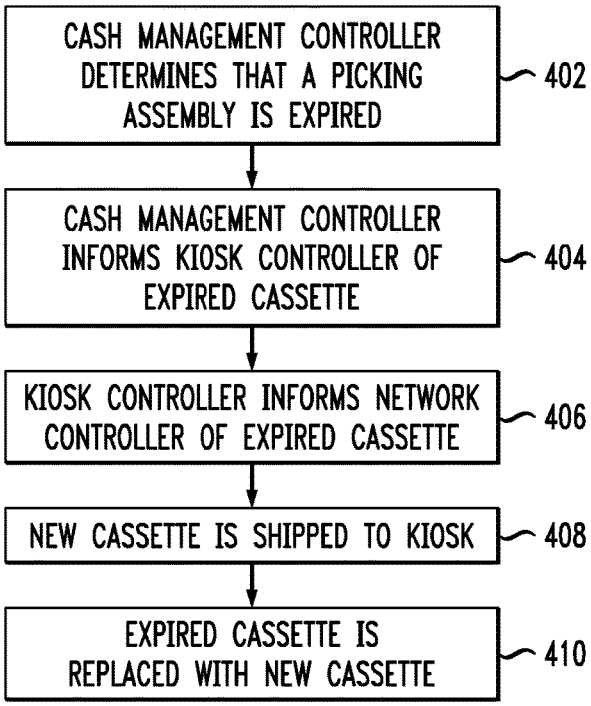
FIG. 4 is a flow diagram of cassette management processing implemented by the casino system of FIG. 1, according to one possible embodiment of the invention.

FIG. 4 is a flow diagram of cassette management processing implemented by the casino system 100 of FIG. 1, according to one possible embodiment of the invention. The processing begins in step 402 with the CM controller 302 of FIG. 3 determining that the corresponding picking assembly 308 has expired. As discussed previously, the following may be some (but not necessarily all) of the different reasons for determining that a picking assembly has expired:

- The picking assembly has dispensed more than a specified number of bills;
- The picking assembly may have been deployed for longer than a specified length of time; and/or
- The picking assembly may be dispensing too many improper bills, where a bill may be improper if, for example, it has the wrong denomination or if it is folded or torn.

In step 404, the CM controller 302 transmits a message via the communication interface 304 informing the kiosk controller 202 of FIG. 2 that the picking assembly 308 has expired and the cash cassette needs to be replaced. In step 406, the kiosk controller 202 transmits a message via the network interface 222 and the communication network 104 of FIG. 1 informing the network server 106 that the expired cash cassette needs to be replaced. In step 408, a new cash cassette is shipped to the kiosk location and, in step 410, the existing cash cassette is replaced with the new cash cassette without having to replace all of the kiosk's other, unexpired cash cassettes.

Note that, in general, the intelligence for determining whether or not a picking assembly has expired can reside in or be distributed among and between the CM controller 302 of FIG. 3, the kiosk controller 202 of FIG. 2, and/or the network server 106 of FIG. 1. In the implementation of FIG. 4, that intelligence resides entirely within the CM controller 302. In another possible implementation, that intelligence resides within the kiosk controller 202. In that case, each cassette 206 may be assigned a unique ID number that is detected by the cash dispenser 204, when the cassette is inserted into the kiosk 200. As bills are dispensed from the kiosk 200, the cash dispenser 204 sends information identifying the ID numbers of the corresponding cassettes 206 and the corresponding numbers of dispensed bills to the kiosk controller 202, which may then communicate with the server 106 of FIG. 1 via the network interface 222 and the communication network 104.

In one embodiment, the invention is a cash cassette for a cash machine. The cash cassette comprises a cash store adapted to store currency bills; a picking assembly adapted to retrieve currency bills from the cash store for dispensing from the cash machine; and a cassette controller adapted to control operations of the cash cassette, wherein the cassette controller is adapted to determine that the cash cassette should be replaced.

In certain embodiments of the foregoing, the cassette controller is adapted to determine that the cash cassette should be replaced after the cassette controller determines at least one of (i) the picking assembly has dispensed a threshold number of currency bills; (ii) the picking assembly has been deployed for a threshold length of time; and (iii) the picking assembly has retrieved improper currency bills.

In certain embodiments of the foregoing, the cassette controller is adapted to determine that the cash cassette should be replaced after the cassette controller determines any of (i) the picking assembly has dispensed the threshold number of currency bills; (ii) the picking assembly has been deployed for the threshold length of time; and (iii) the picking assembly has retrieved improper currency bills.

In certain embodiments of the foregoing, the cassette controller is adapted to determine that a currency bill is an improper currency bill if at least one of (a) the currency bill is folded; (b) the currency bill is torn; and (c) the currency bill has an incorrect denomination.

In certain embodiments of the foregoing, the cassette controller is adapted to transmit a cassette-replacement message to a controller of the cash machine after determining that the cash cassette should be replaced.

In certain embodiments of the foregoing, the cash machine is a casino kiosk, and the cash cassette is adapted to be deployed in the casino kiosk.

Embodiments of the invention can be manifest in the form of methods and apparatuses for practicing those methods. Embodiments of the invention can also be manifest in the form of program code embodied in tangible media, such as magnetic recording media, optical recording media, solid state memory, floppy diskettes, CD-ROMs, hard drives, or any other non-transitory machine-readable storage medium, wherein, when the program code is loaded into and executed by a machine, such as a computer, the machine becomes an apparatus for practicing the invention. Embodiments of the invention can also be manifest in the form of program code, for example, stored in a non-transitory machine-readable storage medium including being loaded into and/or executed by a machine, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits Any suitable processor-usable/readable or computer-usable/readable storage medium may be utilized. The storage medium may be (without limitation) an electronic, magnetic, optical, electromagnetic, infrared, or semiconductor system, apparatus, or device. A more-specific, non-exhaustive list of possible storage media include a magnetic tape, a portable computer diskette, a hard disk, a random access memory (RAM), a read-only memory (ROM), an erasable programmable read-only memory (EPROM) or Flash memory, a portable compact disc read-only memory (CD-ROM), an optical storage device, and a magnetic storage device. Note that the storage medium could even be paper or another suitable medium upon which the program is printed, since the program can be electronically captured via, for instance, optical scanning of the printing, then compiled, interpreted, or otherwise processed in a suitable manner including but not limited to optical character recognition, if necessary, and then stored in a processor or computer memory. In the context of this disclosure, a suitable storage medium may be any medium that can contain or store a program for use by or in connection with an instruction execution system, apparatus, or device.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A cash cassette for a cash machine, the cash cassette comprising:

a cash store adapted to store currency bills;

a picking assembly (a) adapted to retrieve currency bills from the cash store for dispensing from the cash machine and (b) having an expected end of its operating life; and a cassette controller adapted to control operations of the cash cassette, wherein the cassette controller is adapted to determine that the picking assembly of the cash cassette (1) is approaching the expected end of its operating life and (2) should be replaced after the cassette controller determines that at least one of:

(i) the picking assembly has dispensed, over its operating life, a total number of currency bills at least equal to a threshold number of currency bills;

(ii) the picking assembly has been deployed, over its operating life, for a threshold length of time;

(iii) the picking assembly has retrieved a currency bill that is folded; and (iv) the picking assembly has retrieved a currency bill that is torn.

2. The cash cassette of claim 1, wherein the cassette controller is adapted to determine that the picking assembly of the cash cassette is approaching the expected end of its operating life and should be replaced after the cassette controller determines that the picking assembly has dispensed, over its operating life, a total number of currency bills at least equal to the threshold number of currency bills.

3. The cash cassette of claim 1, wherein the cassette controller is adapted to determine that the picking assembly of the cash cassette is approaching the expected end of its operating life and should be replaced after the cassette controller determines that the picking assembly has been deployed, over its operating life, for the threshold length of time.

4. The cash cassette of claim 1, wherein the cassette controller is adapted to determine that the picking assembly of the cash cassette is approaching the expected end of its operating life and should be replaced after the cassette controller determines that the picking assembly has retrieved a currency bill that is folded.

5. The cash cassette of claim 1, wherein the cassette controller is adapted to transmit a cassette-replacement message to a controller of the cash machine in response to the cassette controller determining that the picking assembly of the cash cassette is approaching the expected end of its operating life and should be replaced.

6. The cash cassette of claim 1, wherein:

the cash machine is a casino kiosk; and the cash cassette is adapted to be deployed in the casino kiosk.

7. The cash cassette of claim 1, wherein the cassette controller is adapted to determine that the picking assembly of the cash cassette is approaching the expected end of its operating life and should be replaced after the cassette controller determines that the picking assembly has retrieved a currency bill that is torn.

8. A method for managing a cash machine having at least one deployed cash cassette having a picking assembly having an expected end of its operating life, the method comprising:

(a) determining, by an electronic controller, that the picking assembly of the deployed cash cassette (1) is approaching the expected end of its operating life and (2) should be replaced after determining, by the electronic controller, that at least one of:

(i) the picking assembly has dispensed, over its operating life, a total number of currency bills at least equal to a threshold number of currency bills;

(ii) the picking assembly has been deployed, over its operating life, for a threshold length of time;

(iii) the picking assembly has retrieved a currency bill that is folded; and (iv) the picking assembly has retrieved a currency bill that is torn; and (b) generating, by the electronic controller in response to the electronic controller determining that the picking assembly of the deployed cassette is (1) is approaching the expected end of its operating life and (2) should be replaced, a cassette-replacement message in order to have a new cash cassette shipped to the cash machine to enable the deployed cash cassette to be replaced with the new cash cassette.

9. The method of claim 8, wherein the electronic controller is a cassette controller that is part of the deployed cash cassette.

10. The method of claim 8, wherein the electronic controller is a controller for the cash machine.

11. The method of claim 8, wherein step (a) comprises the electronic controller determining that the picking assembly of the deployed cash cassette is approaching the expected end of its operating life and should be replaced after determining that the picking assembly has dispensed, over its operating life, a total number of currency bills at least equal to the threshold number of currency bills.

12. The method of claim 8, wherein step (a) comprises the electronic controller determining that the picking assembly of the deployed cash cassette is approaching the expected end of its operating life and should be replaced after determining that the picking assembly has been deployed, over its operating life, for the threshold length of time.

13. The method of claim 8, wherein step (a) comprises the electronic controller determining that the picking assembly of the deployed cash cassette is approaching the expected end of its operating life and should be replaced after determining that the picking assembly has retrieved a currency bill that is folded.

14. The method of claim 8, wherein step (a) comprises the electronic controller determining that the picking assembly of the deployed cash cassette is approaching the expected end of its operating life and should be replaced after determining that the picking assembly has retrieved a currency bill that is torn.

15. An apparatus for managing a cash machine having at least one deployed cash cassette having a picking assembly having an expected end of its operating life, the apparatus comprising:

(a) means for determining that the picking assembly of the deployed cash cassette (1) is approaching the expected end of its operating life and (2) should be replaced after determining, by the determining means, that at least one of:

(i) the picking assembly has dispensed, over its operating life, a total number of currency bills at least equal to a threshold number of currency bills;

(ii) the picking assembly has been deployed, over its operating life, for a threshold length of time;

(iii) the picking assembly has retrieved a currency bill that is folded; and (iv) the picking assembly has retrieved a currency bill that is torn; and (b) means for generating, in response to means (a) determining that the picking assembly of the deployed cassette is (1) is approaching the expected end of its operating life and (2) should be replaced, a cassette-replacement message in order to have a new cash cassette shipped to the cash machine to enable the deployed cash cassette to be replaced with the new cash cassette.

* * * * *